United States Patent [19]

Bernhard

[11] Patent Number: 4,694,613

[45] Date of Patent: Sep. 22, 1987

[54] RELIEF GRINDING OF LAWN MOWER CYLINDRICAL BLADES

[75] Inventor: Stephen Bernhard, Rugby, England

[73] Assignee: Atterton and Ellis Limited, England

[21] Appl. No.: 826,606

[22] Filed: Feb. 6, 1986

[30] Foreign Application Priority Data

Feb. 7, 1985 [GB] United Kingdom ..... 8503151

[51] Int. Cl.[4] ..... B24B 7/00

[52] U.S. Cl. ..... 51/34 C; 51/48 HE

[58] Field of Search ..... 51/48 HE, 34 C, 34 F, 51/34 G, 246, 248, 254, 34 R

[56] References Cited

U.S. PATENT DOCUMENTS

| | | | |
|---|---|---|---|
| 426,192 | 4/1890 | Mansfield | 51/254 |
| 2,601,574 | 6/1952 | Weaver | 51/48 HE |
| 4,148,158 | 4/1979 | Hewitt | 51/48 HE |

*Primary Examiner*—Frederick R. Schmidt
*Assistant Examiner*—Maurina Rachuba
*Attorney, Agent, or Firm*—Banner, Birch, McKie & Beckett

[57] ABSTRACT

In a grinding machine for relief grinding the blades of a lawn mower blade cylinder having a rotatable drive shaft (14) on which a grinding wheel (20) is mounted for rotation therewith and for axial movement therealong, a grinding wheel guide assembly (30,34,42) to traverse the grinding wheel axially of the drive shaft and means (46) for causing the traverse of the guide assembly alternately in opposite directions so that the grinding wheel reciprocates along the drive shaft during rotation thereof, a blade guide assembly (53) comprising a guide finger (54) axially slidable along a fixed guide shaft (57) mounted parallel to the drive shaft, a guide element (58) engageable with that face of a blade to be ground which is remote from the grinding wheel and connecting means (60,62) coupling the guide finger to the traverse means and locking means (66) to releasably engage the grinding wheel guide assembly and the blade guide assembly with the traverse means.

4 Claims, 2 Drawing Figures

RELIEF GRINDING OF LAWN MOWER CYLINDRICAL BLADES

This invention relates to the relief grinding of cylindrical blades for lawn mowers and more particularly to a blade guide assembly for maintaining each blade to be ground in contact with a grinding wheel.

Relief grinding or backing off as it is sometimes referred to involves removing a portion of the back face of a blade to create a land. The term back face refers to the trailing edge of the blade in relation to its direction of rotation relative to the bed knife (bottom blade) of a cylindrical blade mowing machine.

Relief grinding results in a blade having a reduced blade tip area which minimizes the braking effect arising by interference between the rotating blade cylinder and the fixed bed knife of a mowing machine.

One aspect of the invention provides, in a grinding machine for relief grinding the blades of a lawn mower blade cylinder having a rotatable drive shaft on which a grinding wheel is mounted for rotation therewith and for axial movement therealong, a grinding wheel guide assembly to traverse the grinding wheel axially of said drive shaft and means for causing said traverse of the guide assembly alternately in opposite directions so that the grinding wheel reciprocates along the drive shaft during rotation thereof, a blade guide assembly comprising a guide finger axially slidable along a fixed guide shaft mounted parallel to said drive shaft, a guide element engageable with that face of a blade to be ground which is remote from the grinding wheel connecting means coupling said guide finger to said traverse means and locking means to releasably engage the grinding wheel guide assembly and the blade guide assembly with the traverse means.

Another aspect of the invention provides a grinding machine for spin-grinding the blades of a lawn mower blade cylinder which machine includes a rotatable drive shaft on which a grinding wheel is mounted for rotation therewith and for axial movement therealong traverse means for causing said axial movement of the grinding wheel and drive means for causing rotation of a blade cylinder presented to the grinding wheel in which the drive shaft, the traverse means and blade cylinder drive means are actuated by a common hydraulic source.

A grinding machine embodying both aspects of the invention will now be described, by way of example, with reference to the accompanying drawings, in which.

Figure 1:
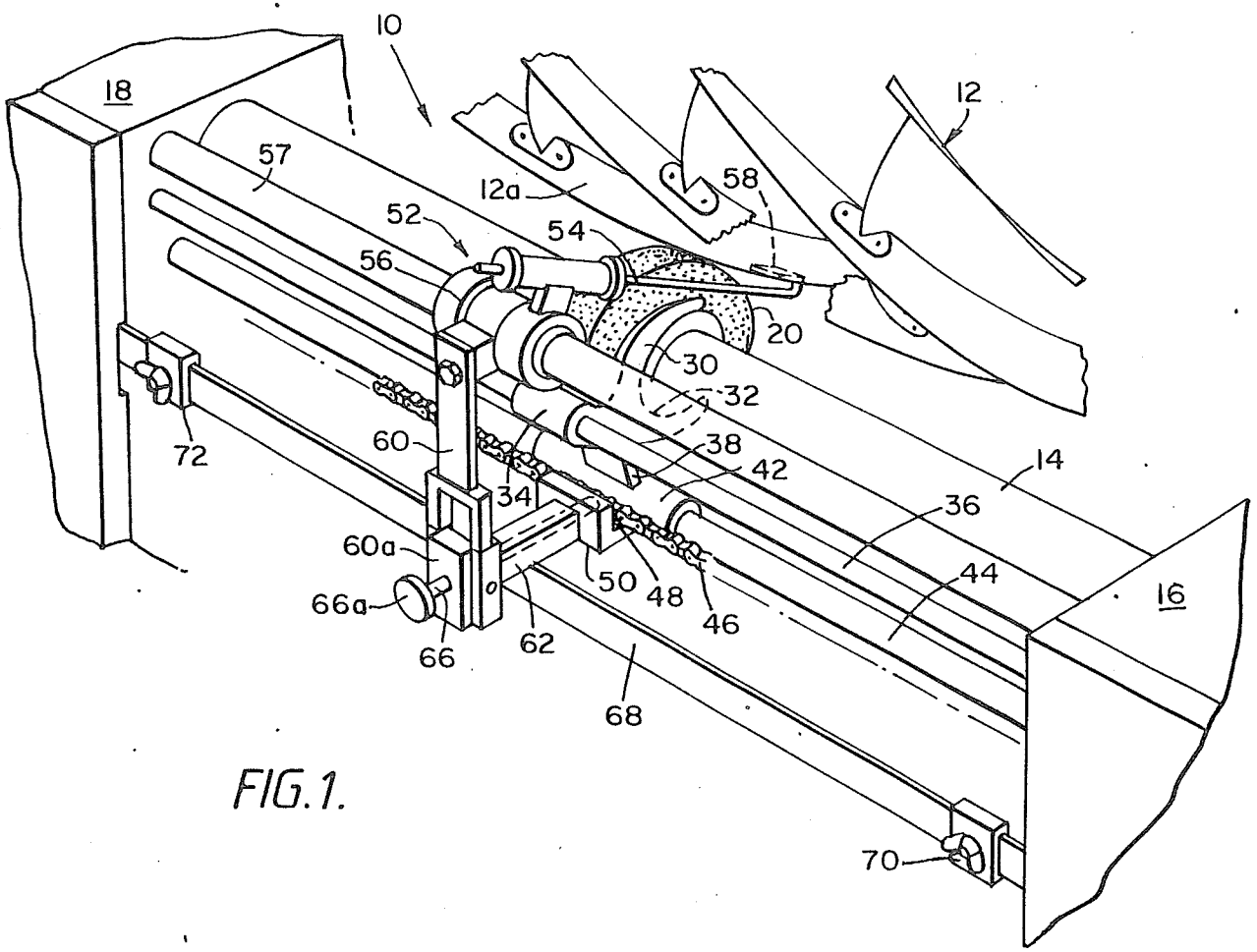
FIG. 1 is a schematic perspective view of a blade guide assembly mounted in a cylindrical blade grinding machine in accordance with one aspect of the invention.
Figure 2:
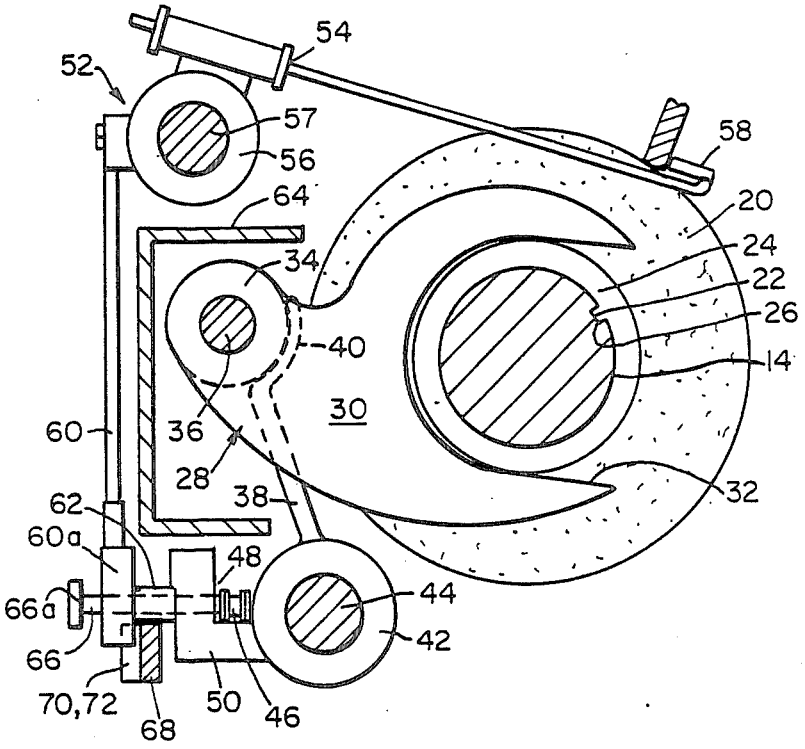
FIG. 2 is a part sectional view of the assembly.

Referring to FIGS. 1 and 2 of the drawings, a grinding machine 10 for sequentially relief grinding each of the blades of a lawn mower blade cylinder or reel 12 comprises a main drive shaft 14 which is journalled at each of its opposite ends in housing structures 16, 18 respectively of the machine.

The drive shaft is driven by a motor (not shown) accommodated in housing structure 16 or may be hydraulically driven as referred to later.

A grinding disc 20 is mounted upon the main drive shaft for axial movement therealong by a key 22 carried by an inner annulus 24 of the disc which cooperates with a longitudinal keyway 26 formed in the drive shaft 14.

A fork assembly 28 includes a pair of spaced fork arms, only one 30 of which is shown and each of which includes a clevis portion 32 which engages one of the opposed faces of the grinding disc. The fork arms are integral with and extend from a boss 34 which is slidingly mounted on a fixed inner guide shaft 36 extending between the housing structures and whose axis is parallel to that of drive shaft 14. A support arm 38 of the fork assembly includes an arcuate end portion 40 which engages a peripheral portion of the boss 34. The opposite end of the support arm is connected to a sleeve 42 slidingly mounted on a traverse shaft 44 (third fixed shaft) extending between the housing structures below guide shaft 36 whose axis also is parallel to that of drive shaft 14.

An endless traverse chain, only the upper run 46 of which is shown, is entrained about a drive sprocket (not shown) located in housing structure 16 and an idler sprocket (not shown) located in housing structure 18. The upper run of the traverse chain passes through a recess 48 formed between an 'L'-shaped bracket 50 extending from sleeve 42 and the wall of the sleeve 42 and can be engaged as described later to reciprocate the fork assembly along shafts 36 and 44 and the grinding disc along shaft 14.

A blade guide assembly is generally designated by reference numeral 52. Guide assembly 52 comprises an axially adjustable guide finger 54 mounted adjacent one of its ends on a guide sleeve 56 and whose opposite end terminates in a guide plate 58. The guide sleeve 56 is slidably mounted on a second fixed outer guide shaft 57 extending between the housing structures and whose axis also is parallel to that of drive shaft 14. The guide sleeve 56 is interconnected with the fork assembly sleeve 42 by means of a vertically extending link 60 and a horizontally extending spacer tube 62 which attaches to bracket 50, link 60 being mounted externally of frame member 64 of the machine.

A locking device 66 which may be a spring loaded threaded shaft having an enlarged head **66*a* at one end extends through a bush 60*a* at the lower end of link 60 and through the spacer tube 62. The lock device 66 is axially movable by rotating head 66*a* so that its opposite end engages the upper run 46 of traverse chain and locks the chain between bracket 50 and fork assembly sleeve 42. Thus, when the traverse chain is driven with the locking device engaged, drive is transmitted to the blade guide assembly 52 and to the fork assembly and grinding wheel. In a blade grinding operation it is desirable to grind each blade in both directions along its length and therefore it is necessary to provide for reciprocal travel of the fork assembly and grinding wheel and of the blade guide assembly to and fro along their respective shafts. To this end, a longitudinally movable control rod 68 extends between the housing structures one end of which extends through housing structure 16 to operate a control switch for reversing the direction of rotation of the drive motor which actuates the traverse chain. A pair of limit stops 70,72 respectively is adjustably mounted on the control rod each of which may be positioned at selected locations along the rod and interfer with the path of movement of the bush 60*a*** so as to limit the distance of traverse of the blade guide assembly and thus the fork assembly and grinding wheel in either direction between the housing structures.

In a typical single blade grinding operation a portion of the back face of each blade adjacent its free edge is removed. The blade cylinder or reel 12 is rotatably mounted so that the back face of each blade can be presented to the grinding wheel and the cylinder indexed so that the blades are successively ground one at a time.

When the first blade 12*a* is presented to the grinding wheel the guide finger 54 is adjusted so that the guide plate 58 engages that (front) face of the blade which is remote from the grinding wheel and readjusted to ensure that the blade is brought into abutment with the wheel.

The limit stops 70 and 72 are then set at the desired locations along the control rod 68 so that the distance of travel of the grinding wheel accords with the axial length of the blade cylinder. The drive shaft 14 and traverse chain are then actuated so that the grinding wheel is set in rotation and traverses to and fro along drive shaft 14. Likewise, the blade guide assembly is caused to traverse and in so doing the guide plate 58 follows the contour of the blade thereby maintaining the back face to be ground in constant engagement with the grinding wheel.

I claim:

1. A grinding machine for relief grinding the blades of a lawn mower blade cylinder comprising:

housing means for supporting parts of the grinding machine;

a drive shaft rotatably supported by said housing means;

a grinding wheel mounted on said drive shaft for rotation therewith and for axial movement therealong;

separate first, second and third fixed shafts supported by said housing means;

a fork assembly comprising at least one fork arm for coupling said fork assembly to said grinding wheel and a first sleeve for carrying said fork assembly on said first fixed shaft, said first sleeve being axially movable along said first shaft;

traverse means for causing the axial traverse of said fork assembly and said grinding wheel coupled thereto, and for automatically reversing the direction of travel of said fork assembly so that said grinding wheel reciprocates along said drive shaft during rotation thereof;

a blade guide assembly comprising a guide finger, a guide element and, a second sleeve carrying said guide finger and guide element, said second sleeve being axially slidable along said second fixed shaft, and said guide finger being engagable with that face of a blade to be ground which is remote from said grinding wheel;

a third sleeve mounted for axial slidable movement on said third fixed shaft and being connected to said fork assembly for transmitting axial movement to said fork assembly from said traverse means; and connecting means including locking means for releasably coupling both said blade guide assembly and said fork assembly with said traverse means so that said traverse means, said fork assembly and said blade guide assembly can traverse together whereby the back face of the blade to be ground is maintained in constant engagement with the grinding wheel.

2. A grinding machine according to claim 1 wherein said drive shaft and said first fixed shaft are located between said second and third fixed shafts .

3. A grinding machine according to claim 1 or 2 wherein a connecting link extends from said second sleeve remote from said drive shaft and is releasably attached to said third sleeve mounted on said third fixed shaft.

4. A grinding machine according to claim 3 wherein said traverse means comprises an endless chain one stretch of which is interposed between said connecting link and said third sleeve mounted on said third fixed shaft, said locking means being operable to interconnect said traverse chain to said connecting link and to said third sleeve.

* * * * *